US006467544B1

(12) United States Patent
Brown et al.

(10) Patent No.: US 6,467,544 B1
(45) Date of Patent: Oct. 22, 2002

(54) SAMPLE CHAMBER WITH DEAD VOLUME FLUSHING

(75) Inventors: Jonathan Brown, Duneutt (GB); Victor Bolze, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/712,373

(22) Filed: Nov. 14, 2000

(51) Int. Cl.[7] ..... E21B 49/08; E21B 49/10
(52) U.S. Cl. ..... 166/264; 166/167; 175/99
(58) Field of Search ..... 166/264, 163, 166/165, 167; 175/20, 58, 59

(56) References Cited

U.S. PATENT DOCUMENTS

| | | | | |
|---|---|---|---|---|
| 3,385,364 A | * | 5/1968 | Whitten | 166/100 |
| 3,969,937 A | | 7/1976 | Barrington et al. | |
| 4,434,653 A | * | 3/1984 | Montgomery | 166/100 |
| 4,703,799 A | | 11/1987 | Jennings, Jr. et al. | |
| 4,745,802 A | | 5/1988 | Purfurst | |
| 4,860,581 A | | 8/1989 | Zimmerman et al. | |
| 4,879,900 A | * | 11/1989 | Gilbert | 166/264 |
| 4,936,139 A | | 6/1990 | Zimmerman et al. | |
| 4,994,671 A | | 2/1991 | Safinya et al. | |
| 5,056,595 A | | 10/1991 | Desbrandes | |
| 5,166,747 A | | 11/1992 | Schroeder et al. | |
| 5,269,180 A | * | 12/1993 | Dave et al. | 166/250.02 |
| 5,303,775 A | | 4/1994 | Michaels et al. | |
| 5,337,822 A | | 8/1994 | Massie et al. | |
| 5,377,755 A | | 1/1995 | Michaels et al. | |
| 5,609,205 A | * | 3/1997 | Massie et al. | 166/163 |
| 5,644,076 A | | 7/1997 | Proett et al. | |
| 5,662,166 A | * | 9/1997 | Shammai | 166/169 |
| 5,890,549 A | | 4/1999 | Sprehe | |
| 5,901,788 A | * | 5/1999 | Brown et al. | 166/264 |
| 5,934,374 A | | 8/1999 | Hrametz et al. | |
| 5,939,717 A | | 8/1999 | Mullins | |
| 5,956,132 A | | 9/1999 | Donzier | |
| 6,216,804 B1 | | 4/2001 | Aumann et al. | |
| 6,328,103 B1 | | 12/2001 | Pahmiyer et al. | |
| 6,378,631 B1 | | 4/2002 | Aumann et al. | |

FOREIGN PATENT DOCUMENTS

| | | |
|---|---|---|
| EP | 0 791 723 A1 | 8/1997 |

* cited by examiner

*Primary Examiner*—David Bagnell
*Assistant Examiner*—Jennifer H Gay
(74) *Attorney, Agent, or Firm*—J. L. Jennie Salazar

(57) ABSTRACT

A sample module for use in a downhole tool includes a sample chamber for receiving and storing pressurized fluid. A piston is slidably disposed in the chamber to define a sample cavity and a buffer cavity, and the cavities have variable volumes determined by movement of the piston. A first flowline is provided for communicating fluid obtained from a subsurface formation through the sample module. A second flowline connects the first flowline to the sample cavity, and a third flowline connects the sample cavity to one of the first flowline and an outlet port. A first valve is disposed in the second flowline for controlling the flow of fluid from the first flowline to the sample cavity, and a second valve is disposed in the third flowline for controlling the flow of fluid out of the sample cavity, whereby any fluid preloaded in the sample cavity may be flushed therefrom using the formation fluid in the first flowline and the first and second valves.

37 Claims, 8 Drawing Sheets

GM
140p
140
140c
134
126
130
132
124
110p
54
112
110c
54
120
122
118
128
From Reservoir GM
132
54
110c
120
122
118
From Reservoir GM
132
110c
120
122
118
From Reservoir GM
140
134
132
110p
54
120
122
118
From Reservoir

SAMPLE CHAMBER WITH DEAD VOLUME FLUSHING

BACKGROUND OF THE INVENTION

1. Field of the Invention

This invention relates generally to formation fluid sampling, and more specifically to an improved formation fluid sampling module, the purpose of which is to bring high quality formation fluid samples to the surface for analysis, in part, by eliminating the "dead volume" which exists between a sample chamber and the valves which seal the sample chamber in the sampling module.

2. Description of the Related Art

The desirability of taking downhole formation fluid samples for chemical and physical analysis has long been recognized by oil companies, and such sampling has been performed by the assignee of the present invention, Schlumberger, for many years. Samples of formation fluid, also known as reservoir fluid, are typically collected as early as possible in the life of a reservoir for analysis at the surface and, more particularly, in specialized laboratories. The information that such analysis provides is vital in the planning and development of hydrocarbon reservoirs, as well as in the assessment of a reservoir's capacity and performance.

The process of wellbore sampling involves the lowering of a sampling tool, such as the MDT™ formation testing tool, owned and provided by Schlumberger, into the wellbore to collect a sample or multiple samples of formation fluid by engagement between a probe member of the sampling tool and the wall of the wellbore. The sampling tool creates a pressure differential across such engagement to induce formation fluid flow into one or more sample chambers within the sampling tool. This and similar processes are described in U.S. Pat. Nos. 4,860,581; 4,936,139 (both assigned to Schlumberger); U.S. Pat. Nos. 5,303,775; 5,377,755 (both assigned to Western Atlas); and U.S. Pat. No. 5,934,374 (assigned to Halliburton).

The desirability of housing at least one, and often a plurality, of such sample chambers, with associated valving and flow line connections, within "sample modules" is also known, and has been utilized to particular advantage in Schlumberger's MDT tool. Schlumberger currently has several types of such sample modules and sample chambers, each of which provide certain advantages for certain conditions.

"Dead volume" is a phrase used to indicate the volume that exits between the seal valve at the inlet to a sample cavity of a sample chamber and the sample cavity itself. In operation, this volume, along with the rest of the flow system in a sample chamber or chambers, is typically filled with a fluid, gas, or a vacuum (typically air below atmospheric pressure), although a vacuum is undesirable in many instances because it allows a large pressure drop when the seal valve is opened. Thus, many high quality samples are now taken using "low shock" techniques wherein the dead volume is almost always filled with a fluid, usually water. In any case, whatever is used to fill this dead volume is swept into and captured in the formation fluid sample when the sample is collected, thereby contaminating the sample.

The problem is illustrated in FIG. 1, which shows sample chamber 10 connected to flow line 9 via secondary line 11. Fluid flow from flow line 9 into secondary line 11 is controlled by manual shut-off valve 17 and surface-controllable seal valve 15. Manual shut-off valve 17 is typically opened at the surface prior to lowering the tool containing sample chamber 10 into a borehole (not shown in FIG. 1), and then shut at the surface to positively seal a collected fluid sample after the tool containing sample chamber 10 is withdrawn from the borehole. Thus, the admission of formation fluid from flow line 9 into sample chamber 10 is essentially controlled by opening and closing seal valve 16 via an electronic command delivered from the surface through an armored cable known as a "wireline," as is well known in the art. The problem with such sample fluid collection is that dead volume fluid DV is collected in sample chamber 10 along with the formation fluid delivered through flow line 9, thereby contaminating the fluid sample. To date, there arc no known sample chambers or modules that address this problem of contamination resulting from dead volume collection in a fluid sample.

To address this shortcoming, it is a principal object of the present invention to provide an apparatus and method for bringing a high quality formation fluid sample to the surface for analysis.

It is a further object of the present invention to provide a method and apparatus of flushing the dead volume fluid from a sample module prior to the collection of a fluid sample in a sample chamber within the sample module.

It is a further object of the present invention to utilize a controllable inlet and outlet fluidly connected to a sample cavity of a sample module to achieve dead volume flushing.

SUMMARY OF THE INVENTION

The objects described above, as well as various other objects and advantages, are achieved by a sample module for use in a tool adapted for insertion into a subsurface wellbore for obtaining fluid samples therefrom. The sample module includes a sample chamber for receiving and storing pressurized fluid, and a piston slidably disposed in the chamber to define a sample cavity and a buffer cavity, the cavities having variable volumes determined by movement of the piston. A first flowline is provided for communicating fluid obtained from a subsurface formation through the sample module. A second flowline connects the first flowline to the sample cavity, and a third flowline connects the sample cavity to either the first flowline or an outlet port. A first valve is disposed in the second flowline for controlling the flow of fluid from the first flowline to the sample cavity, and a second valve is disposed in the third flowline for controlling the flow of fluid out of the sample cavity, whereby any fluid preloaded in the sample cavity may be flushed therefrom using the formation fluid in the first flowline and the first and second valves.

In a particular embodiment of the present invention, the sample module further includes a third valve disposed in the first flowline for controlling the flow of fluid into the second flowline. The second flowline of this embodiment is connected to the first flowline upstream of the third valve. The third flowline is connected to the sample cavity and to the first flowline, the latter connection being downstream of the third valve.

The present invention may be further equipped, in certain embodiments, with a fourth flowline connected to the buffer cavity of the sample chamber for communicating buffer fluid into and out of the buffer cavity. The fourth flowline is also connected to the first flowline, whereby the collection of a fluid sample in the sample cavity will expel buffer fluid from the buffer cavity into the first flowline via the fourth flowline. In some embodiments of the present invention, a fifth flowline is connected to the fourth flowline and to the first flowline, the latter connection being upstream of the connection between the first and second flowlines, the fifth flowline permitting manipulation of the buffer fluid to create a pressure differential across the piston for selectively drawing a fluid sample into the sample cavity. The fourth and fifth flowlines thus connect the buffer cavity to the first flowline both upstream and downstream of the third valve. When the present invention is so equipped with the fourth and fifth flowlines, manual valves are preferably positioned in these flowlines to select, uphole, whether the buffer fluid is communicated to the first flowline upstream of the third valve or downstream of the third valve.

The present invention may be further defined in terms of an apparatus for obtaining fluid from a subsurface formation penetrated by a wellbore, comprising a probe assembly for establishing fluid communication between the apparatus and the formation when the apparatus is positioned in the wellbore, and a pump assembly for drawing fluid from the formation into the apparatus via the probe assembly. A sample module is provided for collecting a sample of the formation fluid drawn from the formation by the pumping assembly. The sample module includes a chamber for receiving and storing fluid, and a piston slidably disposed in the chamber to define a sample cavity and a buffer/pressurization cavity, the cavities having variable volumes determined by movement of the piston. A first flowline is placed in fluid communication with the pump assembly for communicating fluid obtained from the formation through the sample module. A second flowline connects the first flowline to the sample cavity, and a third flowline connects the sample cavity to one of the first flowline and an outlet port. A first valve is disposed in the second flowline for controlling the flow of fluid from the first flowline to the sample cavity; and a second valve is disposed in the third flowline for controlling the flow of fluid out of the sample cavity. In this manner, any fluid preloaded in the sample cavity may be flushed therefrom using formation fluid and the first and second valves.

A particular embodiment of this inventive apparatus further includes a pressurization system for charging the buffer/pressurization cavity to control the pressure of the collected sample fluid in the sample cavity via the floating piston. The pressurization system preferably includes a valve positioned in a pressurization flowline connected for fluid communication with the buffer/pressurization cavity of the sample chamber. The valve is movable between positions closing the buffer/pressurization cavity and opening the buffer/pressurization cavity to a source of fluid at a greater pressure than the pressure of the formation fluid delivered to the sample cavity.

In one application of this embodiment, the pressurization system controls the pressure of the collected sample fluid within the sample cavity during collection of the sample from the formation, and it utilizes wellbore fluid for this purpose.

In another application of this embodiment, the pressurization system controls the pressure of the collected sample fluid within the collection cavity during retrieval of the apparatus from the wellbore to the surface, and it utilizes a source of inert gas carried by the apparatus for this purpose.

It is preferred that the inventive apparatus is a wireline-conveyed formation testing tool, although the advantages of the present invention are also applicable to a logging-while-drilling (LWD) tool such as a formation tested carried in a drillstring.

The present invention further provides a method for obtaining fluid from a subsurface formation penetrated by a wellbore, comprising the steps of positioning a formation testing apparatus within the wellbore, and establishing fluid communication between the apparatus and the formation. Once fluid communication is established, fluid from the formation is induced to move into the apparatus. A sample of the formation fluid is then delivered to a sample cavity of a sample chamber carried by the apparatus, and at least a portion of the delivered formation fluid is moved through the sample cavity to flush out at least a portion, and preferably all, of a fluid (typically water) precharging the sample cavity. After this flushing step, a sample of the formation fluid is collected within the sample cavity. At some point following the collection of a formation fluid sample, the apparatus is withdrawn from the wellbore to recover the collected sample or, in the case of a multi-sample module, plurality of samples.

In a particular embodiment of the inventive method, the flushing step is accomplished with flow lines leading into and out of the sample cavity, and each of the flow lines is equipped with a seal valve for controlling fluid flow therethrough from a command at the surface. The fluid precharging the sample cavity, as well as the flow lines between the sample cavity and the seal valves controlling access thereto, may be flushed directly out to the borehole or may be flushed into a primary flow line within the apparatus for subsequent use in another module or later discharge to the borehole.

Preferably, the inventive method further includes the step of maintaining the sample collected in the sample cavity in a single phase condition as the apparatus is withdrawn from the wellbore.

It is also preferred in the inventive method that the sample chamber include a floating piston slidably positioned therein so as to define the sample cavity and a buffer/pressurization cavity. Among other things, this permits the buffer/pressurization cavity to be charged to control the pressure of the sample in the sample cavity.

The buffer/pressurization cavity is charged, in one application, with a buffer fluid. The buffer fluid is expelled from the buffer/pressurization cavity in this application by movement of the piston as the formation fluid is delivered to and collected within the sample cavity. In the preferred embodiment of this inventive method, the expelled buffer fluid is delivered to a primary flow line within the apparatus for subsequent use in another module or later discharge to the borehole.

Fluid movement from the formation into the apparatus is induced by a probe assembly engaging the wall of the formation and a pump assembly in fluid communication with the probe assembly, both assemblies being within the apparatus. In a particular embodiment, the pump assembly is fluidly interconnected between the probe assembly and the sample cavity, whereby the pump assembly draws formation fluid via the probe assembly and delivers the formation fluid to the sample cavity.

In another embodiment, wherein the sample chamber includes a floating piston slidably positioned therein so as to define the sample cavity and a buffer/pressurization cavity, and the buffer/pressurization cavity is precharged with a buffer fluid, the pump assembly is fluidly interconnected between the buffer/pressurization cavity and a flow line within the apparatus. In this manner, buffer fluid is drawn from the buffer/pressurization cavity to create a pressure differential across the piston, thereby drawing formation fluid into the sample cavity.

Another method provided by the present invention induces formation fluid into the sample chamber by connecting the buffer cavity of the sample module, via the primary flowline, to another cavity or module which is kept at a pressure lower than the formation pressure, typically atmospheric pressure.

BRIEF DESCRIPTION OF THE DRAWING(S)

The manner in which the present invention attains the above recited features, advantages, and objects can be understood with greater clarity by reference to the preferred embodiments thereof which are illustrated in the accompanying drawings.

It is to be noted however, that the appended drawings illustrate only typical embodiments of this invention and are therefore not to be considered limiting of its scope, for the invention may admit to other equally effective embodiments.

Figure 5B:
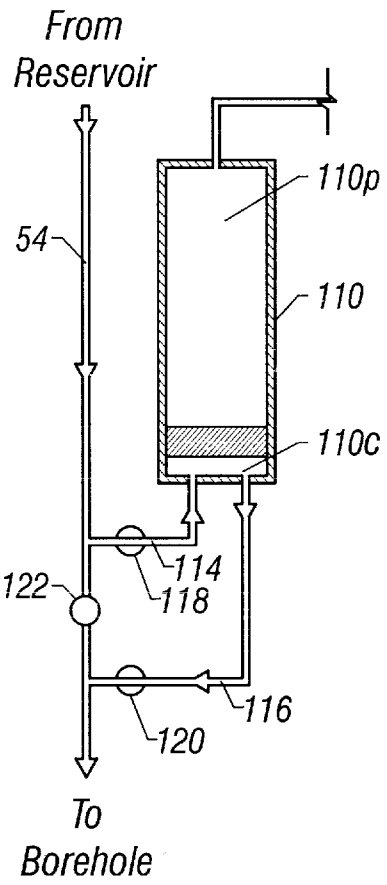
Figure 5A:
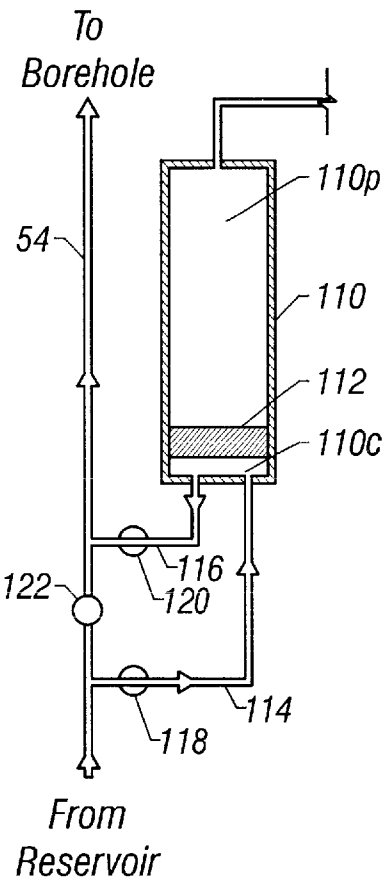

FIGS. 4A–D are sequential, schematic illustrations of a sample module incorporating dead volume flushing according to the present invention;

FIGS. 5A–B are schematic illustrations of sample modules according to the present invention having alternative flow orientations;

FIGS. 6A–D are sequential, schematic illustrations of a sample module according to the present invention wherein buffer fluid is expelled back into the primary flowline as a sample is collected in a sample chamber;

FIGS. 7A–D are sequential, schematic illustrations of a sample module according to the present invention wherein a pump is utilized to draw buffer fluid and thereby induce formation fluid into the sample chamber; and FIGS. 8A–D are sequential, schematic illustrations of a sample module according to the present invention equipped with a gas charge module.

DETAILED DESCRIPTION OF THE INVENTION

Figure 1:
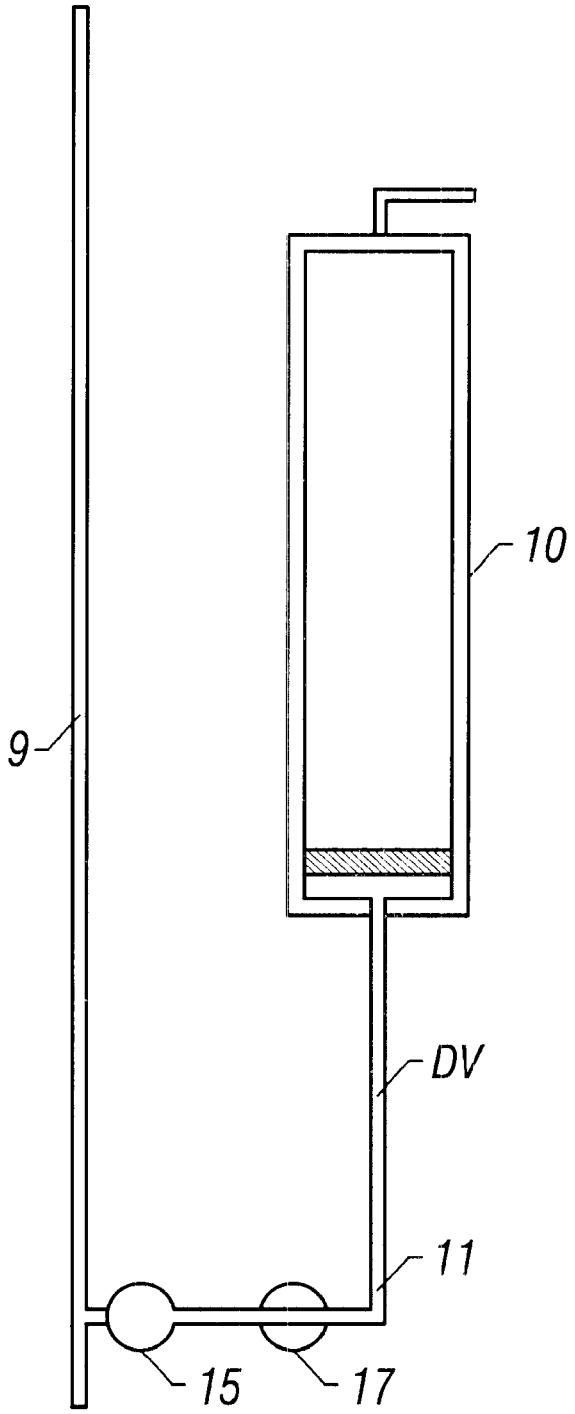
FIG. 1 (Prior Art)
FIG. 1 is a simplified schematic of a prior art sample module, illustrating the problem of dead volume contamination.
Figure 2:
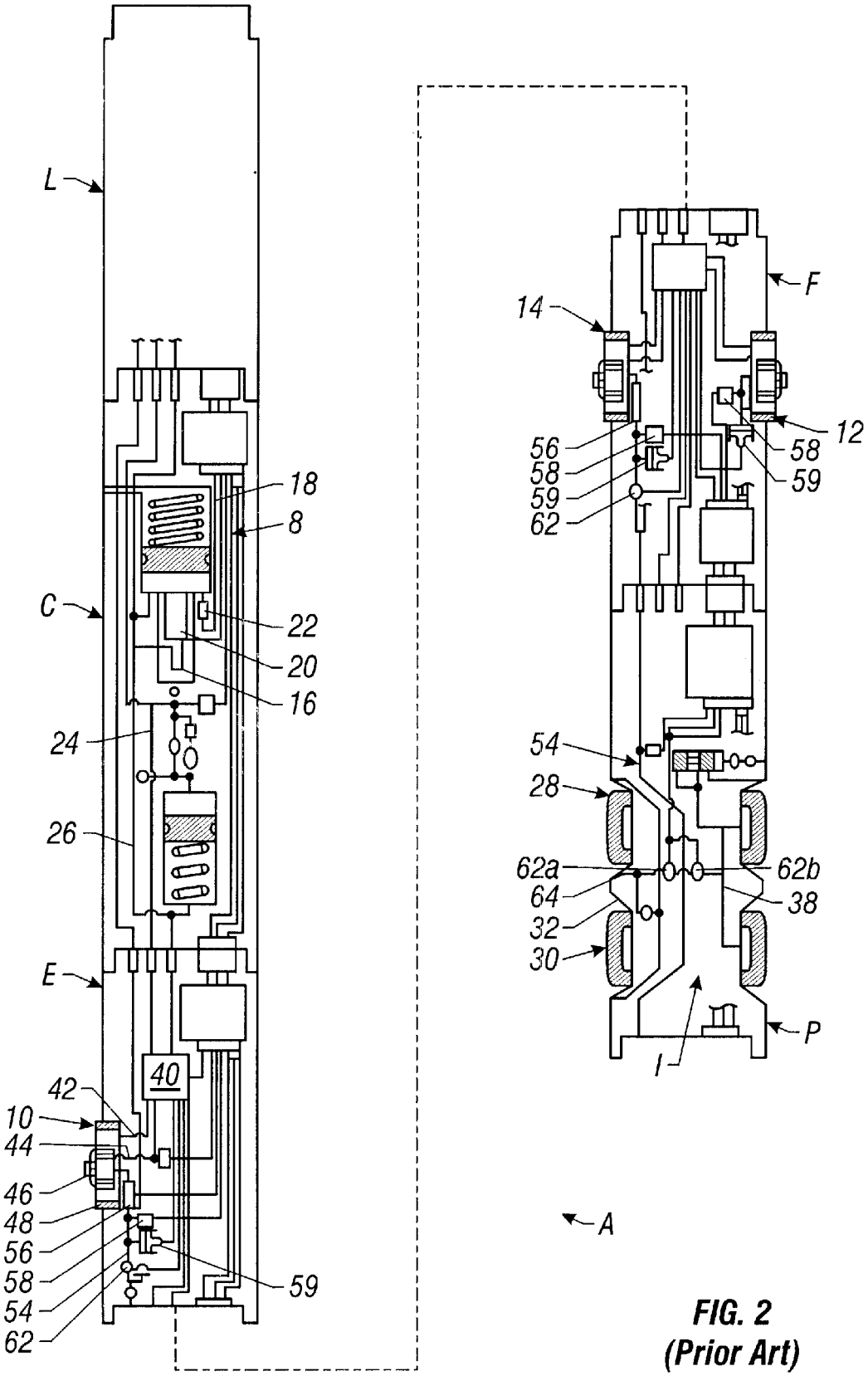
FIG. 2 (Prior Art)
FIGS. 2 and 3 are schematic illustrations of a prior art formation testing apparatus and its various modular components.
Figure 3:
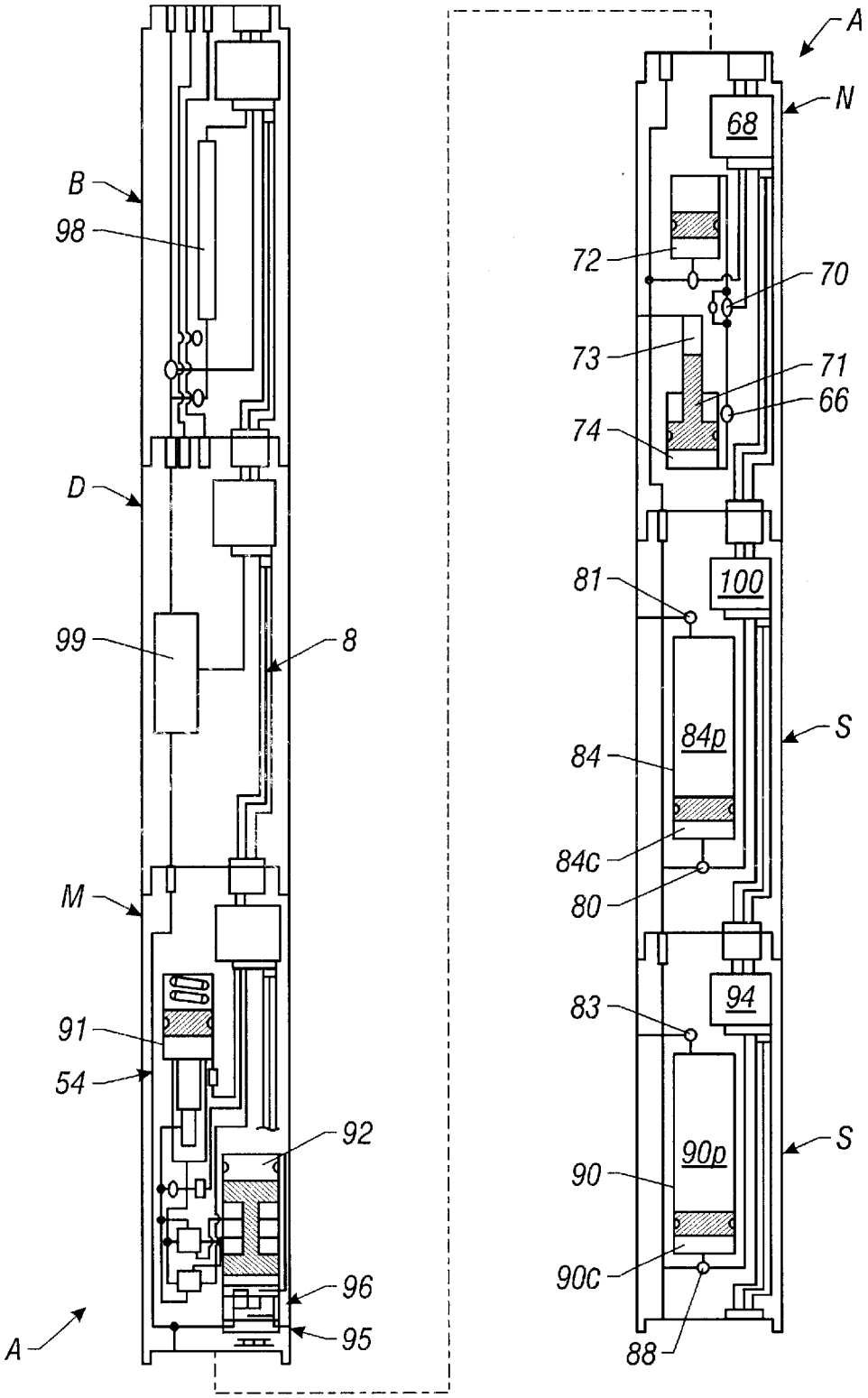
FIG. 3 (Prior Art)

Turning now to prior art FIGS. 2 and 3, a preferred apparatus with which the present invention may be used to advantage is illustrated schematically. The apparatus A of FIGS. 2 and 3 is preferably of modular construction although a unitary tool is also useful. The apparatus A is a down hole tool which can be lowered into the well bore (not shown) by a wire line (not shown) for the purpose of conducting formation property tests. A presently preferred embodiment of such a tool is the MDT (trademark of Schlumberger) tool. The wire line connections to tool A as well as power supply and communications-related electronics are not illustrated for the purpose of clarity. The power and communication lines which extend throughout the length of the tool are generally shown at 8. These power supply and communication components are known to those skilled in the art and have been in commercial use in the past. This type of control equipment would normally be installed at the uppermost end of the tool adjacent the wire line connection to the tool with electrical lines running through the tool to the various components.

As shown in the embodiment of FIG. 2, the apparatus A has a hydraulic power module C, a packer module P, and a probe module E. Probe module E is shown with one probe assembly 10 which may be used for permeability tests or fluid sampling. When using the tool to determine anisotropic permeability and the vertical reservoir structure according to known techniques, a multiprobe module F can be added to probe module E, as shown in FIG. 2. Multiprobe module F has sink probe assemblies 12 and 14.

The hydraulic power module C includes pump 16, reservoir 18, and motor 20 to control the operation of the pump. Low oil switch 22 also forms part of the control system and is used in regulating the operation of pump 16.

Hydraulic fluid line 24 is connected to the discharge of pump 16 and runs through hydraulic power module C and into adjacent modules for use as a hydraulic power source. In the embodiment shown in FIG. 2, hydraulic fluid line 24 extends through hydraulic power module C into probe modules E and/or F depending upon which configuration is used. The hydraulic loop is closed by virtue of hydraulic fluid return line 26, which in FIG. 2 extends from probe module E back to hydraulic power module C where it terminates at reservoir 18.

The pump-out module M, seen in FIG. 3, can be used to dispose of unwanted samples by virtue of pumping fluid through flow line 54 into the borehole, or may be used to pump fluids from the borehole into the flow line 54 to inflate straddle packers 28 and 30. Furthermore, pump-out module M may be used to draw formation fluid from the wellbore via probe module E or F, and then pump the formation fluid into sample chamber module S against a buffer fluid therein. This process will be described further below.

Bi-directional piston pump 92, energized by hydraulic fluid from pump 91, can be aligned to draw from flow line 54 and dispose of the unwanted sample though flow line 95 or may be aligned to pump fluid from the borehole (via flow line 95) to flow line 54. The pumpout module can also be configured where flowline 95 connects to flowline 54 such that fluid may be drawn from the downstream portion of flowline 54 and pumped upstream or vice versa. The pump out module M has the necessary control devices to regulate piston pump 92 and align fluid line 54 with fluid line 95 to accomplish the pump out procedure. It should be noted here that piston pump 92 can be used to pump samples into sample chamber module(s) S, including overpressuring such samples as desired, as well as to pump samples out of sample chamber module(s) S using pump-out module M. Pump-out module M may also be used to accomplish constant pressure or constant rate injection if necessary. With sufficient power, the pump out module may be used to inject fluid at high enough rates so as to enable creation of microfractures for stress measurement of the formation.

Alternatively, straddle packers 28 and 30 shown in FIG. 2 can be inflated and deflated with borehole fluid using piston pump 92. As can be readily seen, selective actuation of the pump-out module M to activate piston pump 92 combined with selective operation of control valve 96 and inflation and deflation valves I, can result in selective inflation or deflation of packers 28 and 30. Packers 28 and 30 are mounted to outer periphery 32 of the apparatus A, and are preferably constructed of a resilient material compatible with wellbore fluids and temperatures. Packers 28 and 30 have a cavity therein. When piston pump 92 is operational and inflation valves I are properly set, fluid from flow line 54 passes through inflation/deflation means I, and through flow line 38 to packers 28 and 30.

As also shown in FIG. 2, the probe module E has probe assembly 10 which is selectively movable with respect to the apparatus A. Movement of probe assembly 10 is initiated by operation of probe actuator 40, which aligns hydraulic flow lines 24 and 26 with flow lines 42 and 44. Probe 46 is mounted to a frame 48, which is movable with respect to apparatus A, and probe 46 is movable with respect to frame 48. These relative movements are initiated by controller 40 by directing fluid from flow lines 24 and 26 selectively into flow lines 42 and 44 with the result being that the frame 48 is initially outwardly displaced into contact with the borehole wall (not shown). The extension of frame 48 helps to steady the tool during use and brings probe 46 adjacent the borehole wall. Since one objective is to obtain an accurate reading of pressure in the formation, which pressure is reflected at the probe 46, it is desirable to further insert probe 46 through the built up mudcake and into contact with the formation. Thus, alignment of hydraulic flow line 24 with flow line 44 results in relative displacement of probe 46 into the formation by relative motion of probe 46 with respect to frame 48. The operation of probes 12 and 14 is similar to that of probe 10, and will not be described separately.

Having inflated packers 28 and 30 and/or set probe 10 and/or probes 12 and 14, the fluid withdrawal testing of the formation can begin. Sample flow line 54 extends from probe 46 in probe module E down to the outer periphery 32 at a point between packers 28 and 30 through adjacent modules and into the sample modules S. Vertical probe 10 and sink probes 12 and 14 thus allow entry of formation fluids into sample flow line 54 via one or more of a resistivity measurement cell 56, a pressure measurement device 58, and a pretest mechanism 59, according to the desired configuration. Also, flowline 32 allows entry of formation fluids into the sample flowline 54. When using module E, or multiple modules E and F, isolation valve 62 is mounted downstream of resistivity sensor 56. In the closed position, isolation valve 62 limits the internal flow line volume, improving the accuracy of dynamic measurements made by pressure gauge 58. After initial pressure tests are made, isolation valve 62 can be opened to allow flow into other modules via flowline 54.

When taking initial samples, there is a high prospect that the formation fluid initially obtained is contaminated with mud cake and filtrate. It is desirable to purge such contaminants from the sample flow stream prior to collecting sample(s). Accordingly, the pump-out module M is used to initially purge from the apparatus A specimens of formation fluid taken through inlet 64 of straddle packers 28, 30, or vertical probe 10, or sink probes 12 or 14 into flow line 54.

Fluid analysis module D includes optical fluid analyzer 99 which is particularly suited for the purpose of indicating where the fluid in flow line 54 is acceptable for collecting a high quality sample. Optical fluid analyzer 99 is equipped to discriminate between various oils, gas, and water. U.S. Pat. Nos. 4,994,671; 5,166,747; 5,939,717; and 5,956,132, as well as other known patents, all assigned to Schlumberger, describe analyzer 99 in detail, and such description; will not be repeated herein, but is incorporated by reference in its entirety.

While flushing out the contaminants from apparatus A, formation fluid can continue to flow through sample flow line 54 which extends through adjacent modules such as precision pressure module B, fluid analysis module D, pump out module M, flow control module N, and any number of sample chamber modules S that may be attached as shown in FIG. 3. Those skilled in the art will appreciate that by having a sample flow line 54 running the length of various modules, multiple sample chamber modules S can be stacked without necessarily increasing the overall diameter of the tool. Alternatively, as explained below, a single sample module S may be equipped with a plurality of small diameter sample chambers, for example by locating such chambers side by side and equidistant from the axis of the sample module. The tool can therefore take more samples before having to be pulled to the surface and can be used in smaller bores.

Referring again to FIGS. 2 and 3, flow control module N includes a flow sensor 66, a flow controller 68, piston 71, reservoirs 72, 73 and 74, and a selectively adjustable restriction device such as a valve 70. A predetermined sample size can be obtained at a specific flow rate by use of the equipment described above.

Sample chamber module S can then be employed to collect a sample of the fluid delivered via flow line 54 and regulated by flow control module N, which is beneficial but not necessary for fluid sampling. With reference first to upper sample chamber module S in FIG. 3, a valve 80 is opened and valves 62, 62A and 62B are held closed, thus directing the formation fluid in flow line 54 into sample collecting cavity 84C in chamber 84 of sample chamber module S, after which valve 80 is closed to isolate the sample. The chamber 84 has a sample collecting cavity 84C and a pressurization/buffer cavity 84*p*. The tool can then be moved to a different location and the process repeated. Additional samples taken can be stored in any number of additional sample chamber modules S which may be attached by suitable alignment of valves. For example, there are two sample chambers S illustrated in FIG. 3. After having filled the upper chamber by operation of shut-off valve 80, the next sample can be stored in the lowermost sample chamber module S by opening shut-off valve 88 connected to sample collection cavity 90C of chamber 90. The chamber 90 has a sample collecting cavity 90C and a pressurization/buffer cavity 90*p*. It should be noted that each sample chamber module has its own control assembly, shown in FIG. 3 as 100 and 94. Any number of sample chamber modules S, or no sample chamber modules, call be used in particular configurations of the tool depending upon the nature of the test to be conducted. Also, sample module S may be a multi-sample module that houses a plurality of sample chambers, as mentioned above.

It should also be noted that buffer fluid in the form of full-pressure wellbore fluid may be applied to the backsides of the pistons in chambers 84 and 90 to further control the pressure of the formation fluid being delivered to sample modules S. For this purpose, valves 81 and 83 are opened, and piston pump 92 of pump-out module M must pump the fluid in flow line 54 to a pressure exceeding wellbore pressure. It has been discovered that this action has the effect of dampening or reducing the pressure pulse or "shock" experienced during drawdown. This low shock sampling method has been used to particular advantage in obtaining fluid samples from unconsolidated formations, plus it allows overpressuring of the sample fluid via piston pump 92.

It is known that various configurations of the apparatus A can be employed depending upon the objective to be accomplished. For basic sampling, the hydraulic power module C can be used in combination with the electric power module L, probe module E and multiple sample chamber modules S. For reservoir pressure determination, the hydraulic power module C can be used with the electric power module L, probe module E and precision pressure module B. For uncontaminated sampling at reservoir conditions, hydraulic power module C can be used with the electric power module L, probe module E in conjunction with fluid analysis module D, pump-out module M and multiple sample chamber modules S. A simulated Drill Stem Test (DST) test can be run by combining the electric power module L with packer module P, and precision pressure module B and sample chamber modules S. Other configurations are also possible and the makeup of such configurations also depends upon the objectives to be accomplished with the tool. The tool can be of unitary construction a well as modular, however, the modular construction allows greater flexibility and lower cost to users not requiring all attributes.

As mentioned above, sample flow line 54 also extends through a precision pressure module B. Precision gauge 98 of module B should preferably be mounted as close to probes 12, 14 or 46, and/or to inlet flowline 32, as possible to reduce internal flow line length which, due to fluid compressibility, may affect pressure measurement responsiveness. Precision gauge 98 is more sensitive than the strain gauge 58 for more accurate pressure measurements with respect to time. Gauge 98 is preferably a quartz pressure gauge that performs the pressure measurement through the temperature and pressure dependent frequency characteristics of a quartz crystal, which is known to be more accurate than the comparatively simple strain measurement that a strain gauge employs. Suitable valving of the control mechanisms can also be employed to stagger the operation of gauge 98 and gauge 58 to take advantage of their difference in sensitivities and abilities to tolerate pressure differentials.

The individual modules of apparatus A are constructed so that they quickly connect to each other. Preferably, flush connections between the modules are used in lieu of male/female connections to avoid points where contaminants, common in a wellsite environment, may be trapped.

Flow control during sample collection allows different flow rates to be used. Flow control is useful in getting meaningful formation fluid samples as quickly as possible which minimizes the chance of binding the wireline and/or the tool because of mud oozing into the formation in high permeability situations. In low permeability situations, flow control is very helpful to prevent drawing formation fluid sample pressure below its bubble point or asphaltene precipitation point.

More particularly, the "low shock sampling" method described above is useful for reducing to a minimum the pressure drop in the formation fluid during drawdown so as to minimize the "shock" on the formation. By sampling at the smallest achievable pressure drop, the likelihood of keeping the formation fluid pressure above asphaltene precipitation point pressure as well as above bubble point pressure is also increased. In one method of achieving the objective of a minimum pressure drop, the sample chamber is maintained at wellbore hydrostatic pressure as described above, and the rate of drawing connate fluid into the tool is controlled by monitoring the tool's inlet flow line pressure via gauge 58 and adjusting the formation fluid flowrate via pump 92 and/or flow control module N to induce only the minimum drop in the monitored pressure that produces fluid flow from the formation. In this manner, the pressure drop is minimized through regulation of the formation fluid flowrate.

Turning now to FIGS. 4A–D, a sample module SM according to the present invention is illustrated schematically. The sample module includes a sample chamber 110 for receiving and storing pressurized formation fluid. Piston 112 is slidably disposed in chamber 110 to define a sample collection cavity 110*c* and a pressurization/buffer cavity 110*p*, the cavities having variable volumes determined by movement of piston 112 within chamber 110. A first flowline 54 is provided for communicating fluid obtained from a subsurface formation (as described above in association with FIGS. 2 and 3) through sample module SM. A second flowline 114 connects first flowline 54 to sample cavity 110*c*, and a third flowline 116 connects sample cavity 110*c* to either first flowline 54 or an outlet port (not shown) in sample module SM.

A first seal valve 118 is disposed in second flowline 114 for controlling the flow of fluid from first flowline 54 to sample cavity 110*c*. A second seal valve 120 is disposed in third flowline 116 for controlling the flow of fluid out of the sample cavity. Given this setup, any fluid preloaded in the "dead volume" defined by sample cavity 110*c* and the portions of flowlines 114 and 116 that are sealed off by seal valves 118 and 120, respectively, may be flushed therefrom using the formation fluid in first flowline 54 and seal valves 118 and 120.

Figures 4A, 4B, 4C, 4D:
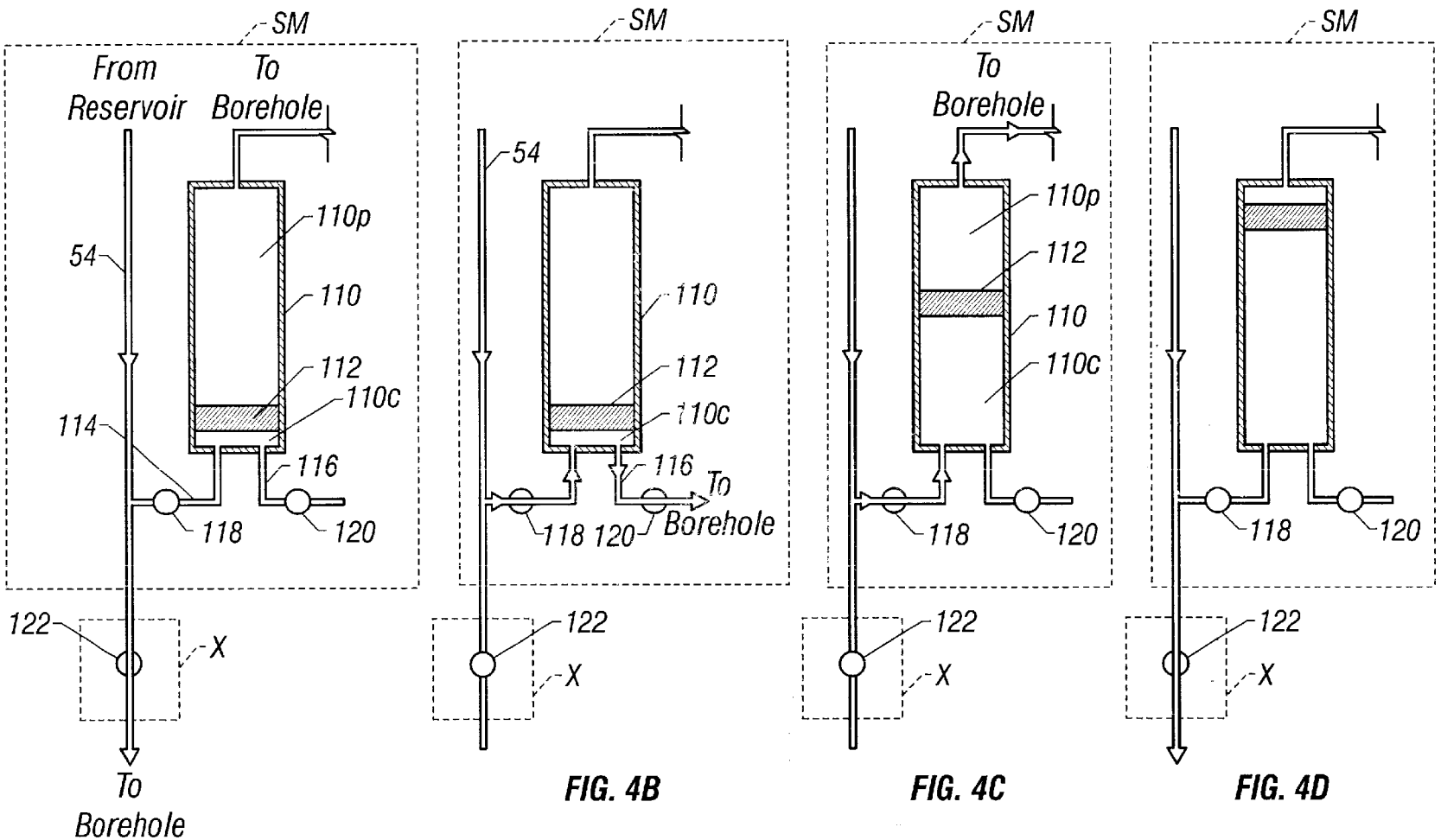

FIG. 4A shows that valves 118 and 120 are both initially closed so that formation fluid being communicated via the above-described modules through first flowline 54 of tool A, including the portion of first flowline 54 passing through sample module SM, bypasses sample chamber 110. This bypass operation permits contaminants in the newly-introduced formation fluid to be flushed through tool A until the amount of contamination in the fluid has been reduced to an acceptable level. Such operation is described above in association with optical fluid analyzer 99.

Typically a fluid such as water will fills the dead volume space between seal valves 118 and 120 to minimize the pressure drop that the formation fluid experiences when the seal valves are opened. When it is desired to capture a sample of the formation fluid in sample cavity 110*c* of sample chamber 110, and analyzer 99 indicates the fluid is substantially free of contaminants, the first step will be to flush the water (although other fluids may be used, water will be described hereinafter) out of the dead volume space. This is accomplished, as seen in FIG. 4B, by opening both seal valves 118 and 120 and blocking first flowline 54 by closing valve 122 within another module X of tool A. This action diverts the formation fluid "in" through first seal valve 118, through sample cavity 110*c*, and "out" through second seal valve 120 for delivery to the borehole. In this manner, any extraneous water disposed in the dead volume between seal valves 118 and 120 will be flushed out with contaminant-free formation fluid.

After a short period of flushing, second seal valve 120 is closed, as shown in FIG. 4C, causing formation fluid to fill sample cavity 110*c*. As the sample cavity is filled, buffer fluid present in buffer/pressurization cavity 110*p* is displaced to the borehole by movement of piston 112.

Once sample cavity 110*c* is adequately filled, first seal valve 118 is closed to capture the formation fluid sample in the sample cavity. Because the buffer fluid in cavity 110*p* is in contact with the borehole in this embodiment of the present invention, the formation fluid must be raised to a pressure above hydrostatic pressure in order to move piston 112 and fill sample cavity 110*c*. This is the low shock sampling method described above. After piston 112 reaches it's maximum travel, pump module M raises the pressure of the fluid in sample cavity 110*c* to some desirable level above hydrostatic pressure prior to shutting first seal valve 118, thereby capturing a sample of formation fluid at a pressure above hydrostatic pressure. This "captured" position is illustrated in FIG. 4D.

The various modules of tool A have the capability of being placed above or below the module (for example, module E, F, and/or P of FIG. 2) which engages the formation. This engagement occurs at a point known as the sampling point. FIGS. 5A–B depict structure for positioning flowline shut-off valve 122 in sample module SM itself while maintaining the ability to place the sample module above or below the sampling point. Shut-off valve 122 is used to divert the flow into the sample cavity from a sampling point below sample chamber 110 in FIG. 5A, and from a sampling point above sample chamber 110 in FIG. 5B. Both figures show formation fluid being diverted from first flowline 54 by shut-off, or third valve 122 into second flowline 114 via first seal valve 118. The fluid passes through sample cavity 110*c* and back to the first flowline 54 via third flowline 116 and second seal valve 120. From there, the formation fluid in flowline 54 may be delivered to other modules of tool A or dumped to the borehole.

The embodiments of FIGS. 4A–D and 5A–B place the buffer fluid in buffer cavity 110*p* in direct contact with the borehole fluid. Again, this results is the low shock method for sampling described above. Sample chamber 110 can also be configured such that no buffer fluid is present behind the piston, and only air fills buffer cavity 110*p*. This would result in a standard air cushion sampling method. However, in order to use some of the other capabilities (described below) of the various modules of tool A, the buffer fluid in buffer cavity 110*p* must be routed back to the flowline, so air is not desirable in these instances.

The present invention may be further equipped in certain embodiments, as shown in FIGS. 6A–D, with a fourth flowline 124 connected to buffer cavity 110*p* of sample chamber 110 for communicating buffer fluid into and out of the buffer cavity. The fourth flowline 124 is also connected to first flowline 54 downstream of shut off valve 122, whereby the collection of a fluid sample in sample cavity 110*c* will expel buffer fluid from buffer cavity 110*p* into first flowline 54 via fourth flowline 124.

A fifth flowline 126 is connected to fourth flowline 124 and to first flowline 54, the latter connection being upstream of the connection between first flowline 54 and second flowline 114. The fourth flowline 124 and fifth flowline 126 permit manipulation of the buffer fluid to create a pressure differential across piston 112 for selectively drawing a fluid sample into sample cavity 110*c*. This process will be explained further below with reference to FIGS. 7A–D.

Figures 6A, 6B, 6C, 6D:
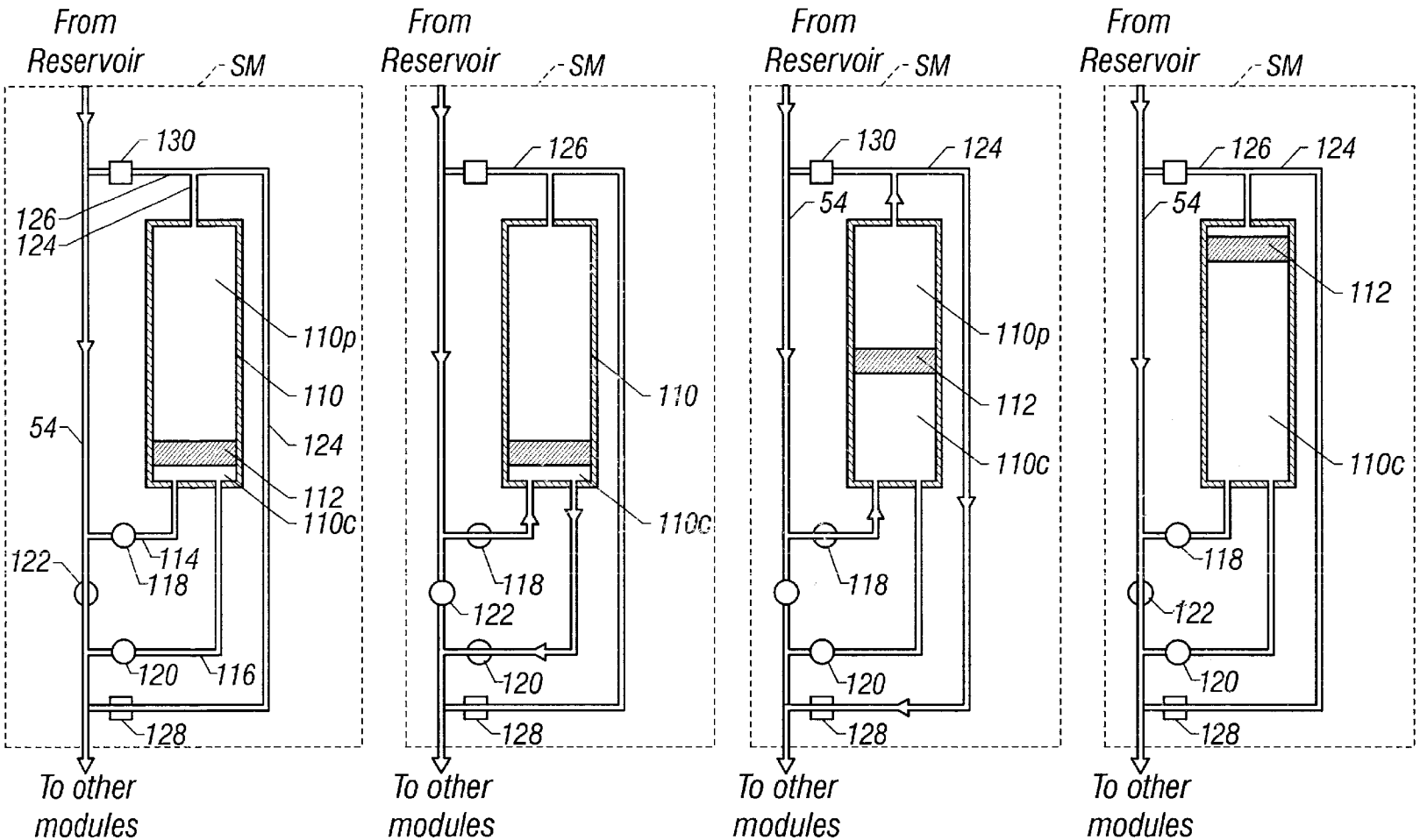

The buffer fluid is routed to first flowline 54 both above flowline seal valve 122 and below the flowline seal valve via flowlines 124 and 126. Depending on whether the formation fluid is flowing from top to bottom (as shown in FIGS. 6A–D) or bottom to top, one of the manual valves 128, 130 in the buffer fluid flowlines is opened and the other one shut. In FIGS. 6A–D, the flow is coming from the top of sample module SM and flowing out the bottom of the sample module, so top manual valve 130 is closed and bottom manual valve 128 is opened. The sample module is initially configured with first and second seal valves 118 and 120 closed and third, flowline seal valve 122 open, as shown in FIG. 6A.

When a sample of formation fluid is desired, the first step again is to flush out the dead volume fluid between fist and second seal valves 118 and 120. This step is shown in FIG. 6B, wherein seal valves 118 and 120 are opened and flowline seal valve 122 is closed. These valve settings divert the formation fluid through sample cavity 110*c* and flush out the dead volume.

After a short period of flushing, second seal valve 120 is closed as seen in FIG. 6C. The formation fluid then fills sample cavity 110*c* and the buffer fluid in buffer cavity 110*p* is displaced by piston 112 into flowline 54 via fourth flowline 124 and open manual valve 128. Because the buffer fluid is now flowing through first flowline 54, it can communicate with other modules of tool A. The flow control module N can be used to control the flow rate of the buffer fluid as it exits sample chamber 110. Alternatively, by placing pump module M below sample module SM, it can be used to draw the buffer fluid out of the sample chamber, thereby reducing the pressure in sample cavity 110*c* and drawing formation fluid into the sample cavity (described further below). Still further, a standard sample chamber with an air cushion can be used as the exit port for the buffer fluid in the event that the pump module fails. Also, first flowline 54 can communicate with the borehole, thereby reestablishing the above-described low shock sampling method.

Once sample chamber 110*c* is filled and piston 112 reaches its upper limiting position, as shown in FIG. 6D, the collected sample may be overpressured (as described above) before closing first and second seal valves 118 and 120 and reopening third, flowline seal valve 122.

The low shock sampling method has been established as a way to minimize the amount of pressure drop on the formation fluid when a sample of this fluid is collected. As stated above, the way this is normally done is to configure sample chamber 110 so that borehole fluid at hydrostatic pressure is in direct communication with piston 112 via buffer cavity 110*p*. A pump of some sort, such as piston pump 92 of pump module M, is used to reduce the pressure of the port which communicates with the reservoir, thereby inducing flow of the formation or formation fluid into tool A. Pump module M is placed between the reservoir sampling point and sample module SM. When it is desired to take a sample, the formation fluid is diverted into the sample chamber. Since piston 112 of the sample chamber is being acted upon by hydrostatic pressure, the pump must increase the pressure of the formation fluid to at least hydrostatic pressure in order to fill sample cavity 110*c*. After the sample cavity is full, the pump can be used to increase the pressure of the formation fluid even higher than hydrostatic pressure in order to mitigate the effects of pressure loss through cooling of the formation fluid when it is brought to surface.

Thus, in low shock sampling, pump module M must lower the pressure at the reservoir interface and then raise the pressure at the pump discharge or outlet to at least hydrostatic pressure. The formation fluid, however, must pass through the pump module to accomplish this. This is a concern, because the pump module may have extra pressure drops associated with it that are not witnessed at the wellbore wall due to check valves, relief valves, porting, and the like. These extraneous pressure drops could have an adverse affect on the integrity of the sample, especially if the drawdown pressure is near the bubble point or asphaltene drop-out point of the formation fluid.

Figure 7D:
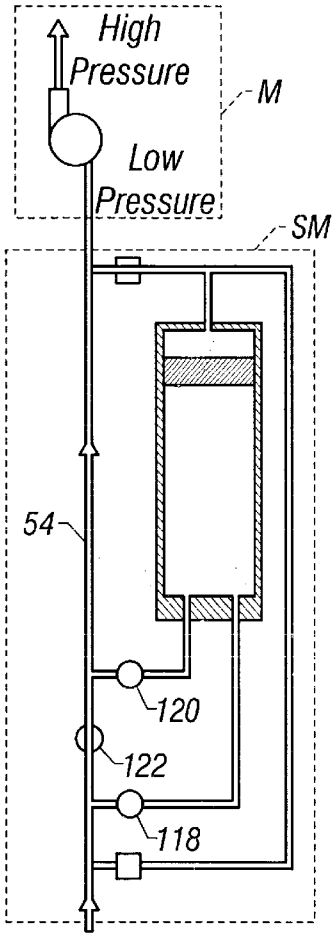
Figure 7C:
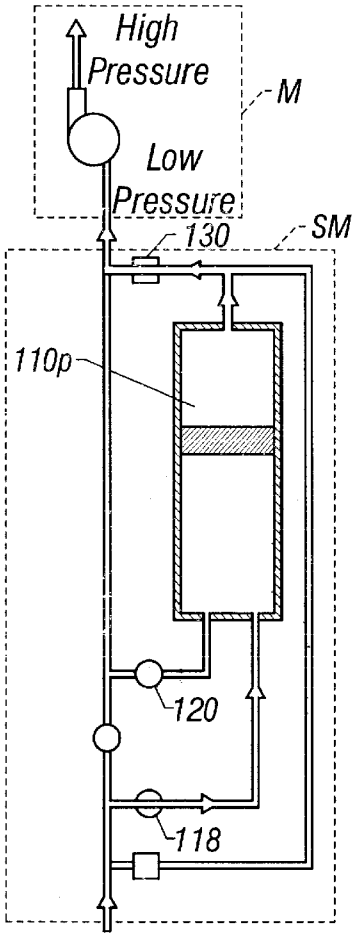
Figure 7B:
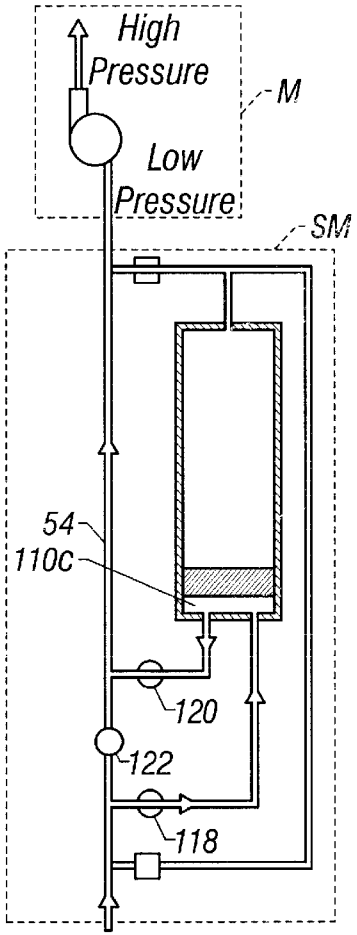
Figure 7A:
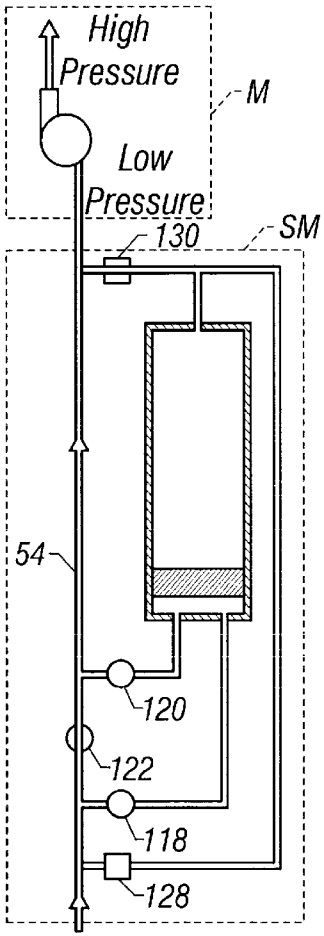

Because of these concerns, a new methodology for sampling that incorporates the advantages of the present invention is now proposed. This involves using pump module M to reduce the pressure at the reservoir interface as described above. However, sample module SM is placed between the sampling point and the pump module. FIGS. 7A–D depict this configuration. Pump module M is used to pump formation fluid through tool A via first flowline 54 and open third seal valve 122, as shown in FIG. 7A, until it is determined that a sample is desired. Both the first seal valve 118 and second seal valve 120 of sample module SM are then opened and third, flowline seal valve 122 is closed, as illustrated by FIG. 7B. This causes the formation fluid in flowline 54 to be diverted through sample cavity 110*c* and flush out the dead volume liquid between valves 118 and 120. After a short period of flushing, second seal valve 120 is closed. Pump module M then has communication only with the buffer fluid in buffer cavity 110*p*. The buffer fluid pressure is reduced via the pump module, whose outlet goes to the borehole at hydrostatic pressure. Since the buffer fluid pressure is reduced below reservoir pressure, the pressure in sample cavity 110*c* behind piston 112 is reduced, thereby drawing formation fluid into the sample cavity as shown in FIG. 7C. When sample cavity 110*c* is full, the sample can be captured by closing first seal valve 118 (seal valve 120 already being closed). The benefits of this method are that the formation fluid is not subjected to any extraneous pressure drops due to the pump module. Also, the pressure gauge which is located near the sampling point in the probe or packer module will indicate the actual pressure (plus/minus the hydrostatic head difference) at which the reservoir pressure enters sample cavity 110*c*.

FIGS. 8A–D illustrate similar structure and methodology to that shown in FIGS. 7A–D, except the former figures illustrate a means to pressurize buffer fluid cavity 110*p* with a pressurized gas to maintain the formation fluid in sample cavity 110*c* above reservoir pressure. This eliminates the need/desire to overpressure the collected sample with the pump module, as described above. Two particular additions in this embodiment are an extra seal valve 132 in fourth-flowline 124 controlling the exit of the buffer fluid from buffer cavity 110*p*, and a gas charging module GM which includes a fifth seal valve 134 to control when pressurized fluid in cavity 140*c* of gas chamber 140 is communicated to the buffer fluid. The chamber 140 has a sample collecting cavity 140C and a pressurization/buffer cavity 140*p*.

Seal valve 132 on the buffer fluid can be used to ensure that piston 112 in sample chamber 110 does not move during the flushing of the sample cavity. In the embodiment of FIGS. 7A–D, there is no means to positively keep piston 112 from moving. During dead volume flushing, the pressure in sample cavity 110*c* is equal to the pressure in buffer cavity 110*p* and therefore piston 112 should not move due to the friction of the piston seals (not shown). To ensure that the piston does not move, it is desirable to have a positive method of locking in the buffer fluid such as seal valve 132. Other alternatives are available, such as using a relief device with a low cracking pressure which would ensure that more pressure is needed to dispel the buffer fluid than to flush the dead volume. Seal valve 132 is also beneficial for capturing the buffer fluid after it has been charged by the nitrogen pressurized charge fluid in cavity 140*c*.

Figures 8A, 8B, 8C, 8D:
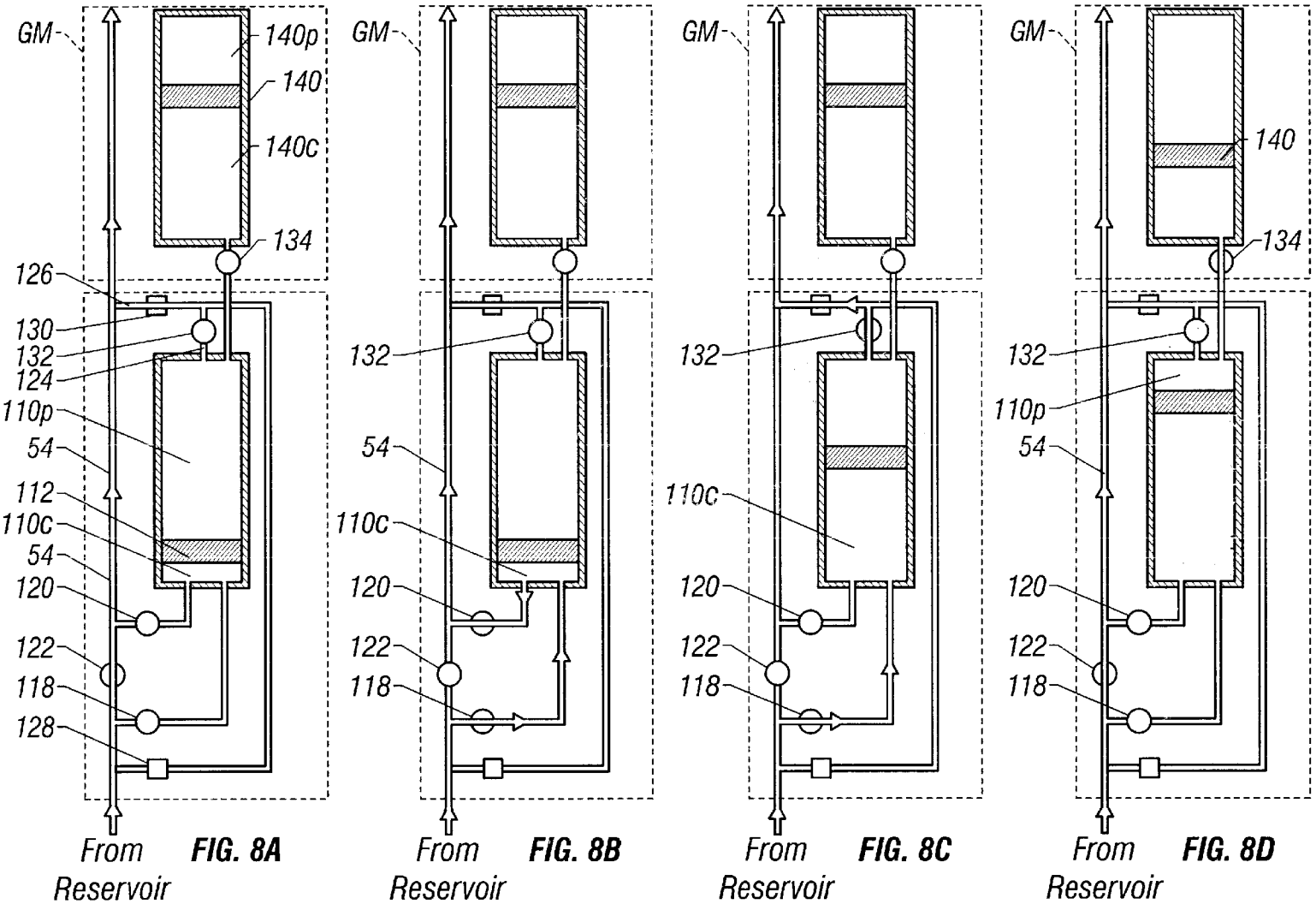

The method of sampling with the embodiment of FIGS. 8A–D is very similar to that described above for the other embodiments. While the formation fluid is being pumped through flowline 54 across various modules to minimize the contamination in the fluid, as seen in FIG. 8A, third seal valve 122 is open while first and second seal valves 118 and 120, along with the buffer seal valve 132 and charge module seal valve 134, are all closed. When a sample is desired, first and second seal valves 118 and 120 are opened, the third, flowline seal valve 122 is closed, and the buffer fluid seal valve 132 remains closed. The formation fluid is thereby pumped through sample cavity 110*c* to flush any water out of the dead volume space between valves 118 and 120, which is shown in FIG. 8B. After a short period of flushing, buffer seal valve 132 is opened, second seal valve 120 is closed (first seal valve 118 remaining open), and the formation fluid begins to fill sample cavity 110*c*, as seen in FIG. 8C. Once sample cavity 110*c* is full, first seal valve 118 is closed, buffer seal valve 132 is closed, and third, flowline seal valve 122 is opened so that pumping and flow through flowline 54 can continue. To pressurize the formation fluid with gas charge module GM, fifth seal valve 134 is opened thereby communicating the charge fluid to buffer cavity 110*p*. Valve 134 remains open as the tool is brought to the surface, thereby maintaining the formation fluid at a higher pressure in sample cavity 110*c* even as sample chamber 110 cools. An alternative tool and method to using a fifth seal valve 134 to actuate the charge fluid in gas module GM has been developed by Oilphase, a division of Schlumberger, and is described in U.S. Pat. No. 5,337,822, which is incorporated herein by reference. In this tool and method, through valving within the sample chamber of bottle 110 itself closes off the buffer and sampling ports and then opens a port to the charge fluid, thereby pressurizing the sample.

Even if there is no gas charge module present in the embodiment illustrated in FIGS. 8A–D, the alternative low shock sampling method described above and depicted in FIGS. 7A–D can still be used. Also, because there is a seal valve 132 which captures the buffer fluid after the formation fluid has been captured in the sample cavity, pump module M can be reversed to pump in the other direction. In other words, the pump module can be utilized to pressurize the buffer fluid in buffer cavity 110*p*, which acts on piston 112, and thereby pressurize the formation fluid captured in sample cavity 110*c*. In essence, this process will duplicate the standard low shock method described above. The fourth seal valve 132 on the buffer fluid can then be closed to capture the appropriately pressurized sample.

In view of the foregoing it is evident that the present invention is well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive. The scope of the invention is indicated by the claims that follow rather than the foregoing description, and all changes which come within the meaning and range of equivalence of the claims are therefore intended to be embraced therein.

What is claimed is:

1. A sample module for use in a tool adapted for insertion into a subsurface wellbore for obtaining fluid samples therefrom, said sample module comprising:

a sample chamber for receiving and storing pressurized fluid;

a piston slidably disposed in said chamber to define a sample cavity and a buffer cavity, the cavities having variable volumes determined by movement of said piston;

a first flowline for communicating fluid obtained from a subsurface formation through the sample module;

a second flowline connecting said first flowline to the sample cavity;

a third flowline connecting the sample cavity to one of said first flowline and an outlet port;

a first valve disposed in said second flowline for controlling the flow of fluid from said first flowline to the sample cavity; and a second valve disposed in said third flowline for controlling the flow of fluid out of the sample cavity, whereby any fluid preloaded in the sample cavity may be flushed therefrom using the formation fluid in said first flowline and said first and second valves.

2. The sample module of claim 1, further comprising a third valve disposed in said first flowline for controlling the flow of fluid into said second flowline.

3. The sample module of claim 2, wherein second flowline is connected to said first flowline upstream of said third valve.

4. The sample module of claim 3, wherein said third flowline is connected to the sample cavity and to said first flowline, the latter connection being downstream of said third valve.

5. The sample module of claim 1, further comprising a fourth flowline connected to the buffer cavity of said sample chamber for communicating buffer fluid into and out of the buffer cavity.

6. The sample module of claim 5, wherein said fourth flowline is also connected to said first flowline, whereby the collection of a fluid sample in the sample cavity will expel the buffer fluid from the buffer cavity into said first flowline via said fourth flowline.

7. The sample module of claim 6, further comprising a third valve disposed in said first flowline for controlling the flow of fluid into said second flowline.

8. The sample module of claim 7, wherein second flowline is connected to said first flowline upstream of said third valve.

9. The sample module of claim 8, wherein said third flowline is connected to the sample cavity and to said first flowline, the latter connection being downstream of said third valve, and said fourth flowline is connected to said first flowline downstream of the connection between the first and third flowlines.

10. The sample module of claim 9, further comprising a fifth flowline connected to said fourth flowline and to said first flowline, the latter connection being upstream of the connection between said first and second flowlines, said fifth flowline permitting manipulation of the buffer fluid to create a pressure differential across said piston for selectively drawing the fluid sample into the sample cavity.

11. The sample module of claim 10, further comprising a manual valve positioned in each of said fourth flowline and said fifth flowline for selecting one of the fourth and fifth flowlines for communicating the buffer fluid from the cavity to the first flowline.

12. An apparatus for obtaining fluid samples from a subsurface formation penetrated by a wellbore, comprising:

a probe assembly for establishing fluid communication between the apparatus and the formation when the apparatus is positioned in the wellbore;

a pump assembly for drawing fluid from the formation into the apparatus via said probe assembly;

a sample module for collecting a sample of the formation fluid drawn from the formation by said pumping assembly, said sample module comprising:

a chamber for receiving and storing the formation fluid;

a piston slidably disposed in said chamber to define a sample cavity and a pressurization cavity, the cavities having variable volumes determined by movement of said piston;

a first flowline in fluid communication with said pump assembly for communicating fluid obtained from the formation through the sample module;

a second flowline connecting said first flowline to the sample cavity;

a third flowline connecting the sample cavity to one of said first flowline fluid and an outlet port;

a first valve disposed in said second flowline for controlling the flow of fluid from said first flowline to the sample cavity; and a second valve disposed in said third flowline for controlling the flow of fluid out of the sample cavity, whereby any fluid preloaded in the sample cavity may be flushed therefrom using formation fluid and said first and second valves.

13. The apparatus of claim 12, further comprising a pressurization system for charging the pressurization cavity to control the pressure of the collected sample fluid in the sample cavity via the floating piston.

14. The apparatus of claim 13, wherein said pressurization system includes a valve positioned in a pressurization flowline for selective fluid communication with the pressurization cavity of said sample chamber, the valve being movable between positions closing the pressurization cavity and opening the pressurization cavity to a source of fluid at a greater pressure than the pressure of the formation fluid delivered to the sample cavity.

15. The apparatus of claim 14, wherein said pressurization system controls the pressure of the collected sample fluid within the sample cavity during collection of the sample from the formation.

16. The apparatus of claim 15, wherein the source of fluid at a greater pressure than the pressure of the collected sample fluid is wellbore fluid.

17. The apparatus of claim 14, wherein said pressurization system controls the pressure of the collected sample fluid within the collection cavity during retrieval of the apparatus from the wellbore to the surface.

18. The apparatus of claim 17, wherein the source of fluid at a greater pressure than the pressure of the collected sample fluid is a source of inert gas carried by the apparatus.

19. The apparatus of claim 12, wherein the apparatus is a wireline-conveyed formation testing tool.

20. A method for obtaining fluid from a subsurface formation penetrated by a wellbore, comprising:

positioning a formation testing apparatus within the wellbore;

establishing fluid communication between the apparatus and the formation;

inducing movement of the fluid from the formation into the apparatus;

delivering a sample of the formation fluid moved into the apparatus to a sample cavity of a sample chamber carried by the apparatus;

flushing out at least a portion of a fluid precharging the sample cavity by inducing movement of at least a portion of the formation fluid though the sample cavity;

collecting the sample of the formation fluid within the sample cavity after the flushing step; and withdrawing the apparatus from the wellbore to recover the sample.

21. The method of claim 20, wherein the flushing step is accomplished with flow lines leading into and out of the sample cavity.

22. The method of claim 21, wherein each of the flow lines is equipped with a seal valve for controlling fluid flow therethrough.

23. The method of claim 20, wherein the flushing step includes flushing the precharging fluid out to the borehole.

24. The method of claim 20, wherein the flushing step includes flushing the precharging fluid into a primary flow line within the apparatus.

25. The method of claim 20, further comprising the step of maintaining the sample collected in the sample cavity in a single phase condition as the apparatus is withdrawn from the wellbore.

26. The method of claim 20, wherein the sample chamber includes a floating piston slidably positioned therein so as to define the sample cavity and a pressurization cavity.

27. The method of claim 26, wherein the pressurization cavity is charged to control the pressure of the sample fluid within the collection cavity during collection of the sample from the formation.

28. The method of claim 27, wherein the pressurization cavity is charged by wellbore fluid.

29. The method of claim 27, wherein the pressurization cavity is charged with a buffer fluid.

30. The method of claim 29, wherein the buffer fluid is expelled from the pressurization cavity by movement of the piston as the formation fluid is delivered to and collected within the sample cavity.

31. The method of claim 30, wherein the expelled buffer fluid is delivered to a primary flow line within the apparatus.

32. The method of claim 26, wherein the pressurization cavity is charged to control the pressure of the sample fluid collected within the sample cavity during retrieval of the apparatus from the wellbore to the surface.

33. The method of claim 32, wherein the pressurization cavity is charged by a source of inert gas.

34. The method of claim 20, wherein fluid movement from the formation into the apparatus is induced by a probe assembly engaging the wall of the formation and a pump assembly in fluid communication with the probe assembly, both assemblies being within the apparatus.

35. The method of claim 34, wherein the pump assembly is fluidly interconnected between the probe assembly and the sample cavity, whereby the pump assembly draws formation fluid via the probe assembly and delivers the formation fluid to the sample cavity.

36. The method of claim 34, wherein the sample chamber includes a floating piston slidably positioned therein so as to define the sample cavity and a pressurization cavity, the pressurization cavity being precharged with a buffer fluid, and the pump assembly being fluidly interconnected between the pressurization cavity and a flow line within the apparatus for drawing buffer fluid from the pressurization cavity to create a pressure differential across the piston, thereby drawing formation fluid into the sample cavity.

37. The method of claim 20, further comprising repeating the steps for multiple samples.

* * * * *